United States Patent [19]

Emmison et al.

[11] Patent Number: 4,940,899

[45] Date of Patent: Jul. 10, 1990

[54] TRANSPORT AND STORAGE FLASK

[75] Inventors: John Emmison, Warrington; Anthony R. Cory, Knutsford, both of England

[73] Assignee: British Nuclear Fuels plc, Warrington, England

[21] Appl. No.: 273,565

[22] Filed: Nov. 21, 1988

[30] Foreign Application Priority Data

Dec. 18, 1987 [GB] United Kingdom ..... 8729504

[51] Int. Cl.[5] ..... G21F 5/00

[52] U.S. Cl. ..... 250/506.1; 250/518.1

[58] Field of Search ..... 250/506.1, 518.1; 376/272

[56] References Cited

U.S. PATENT DOCUMENTS 4,234,798 11/1980 Baatz et al. ..... 250/506.1
4,445,042 4/1984 Baatz et al. ..... 250/506.1
4,453,081 6/1984 Christ et al. ..... 250/506.1
4,751,021 6/1988 Mollon et al. ..... 250/518.1
4,752,437 6/1988 Ito et al. ..... 250/506.1

FOREIGN PATENT DOCUMENTS 2837631 3/1980 Fed. Rep. of Germany .
1422018 1/1976 United Kingdom .
2038227 7/1980 United Kingdom .
2096046 10/1982 United Kingdom .

*Primary Examiner*—Bruce C. Anderson
*Attorney, Agent, or Firm*—William R. Hinds

[57] ABSTRACT

A transport and storage flask for radioactive material comprising a hollow body having lifting trunnions and external neutron shielding about the body except in the regions of the trunnions. To compensate for lack of shielding at the trunnions, blind bores in the body containing further neutron shielding material extend beneath the trunnions.

4 Claims, 1 Drawing Sheet

Fig.1.
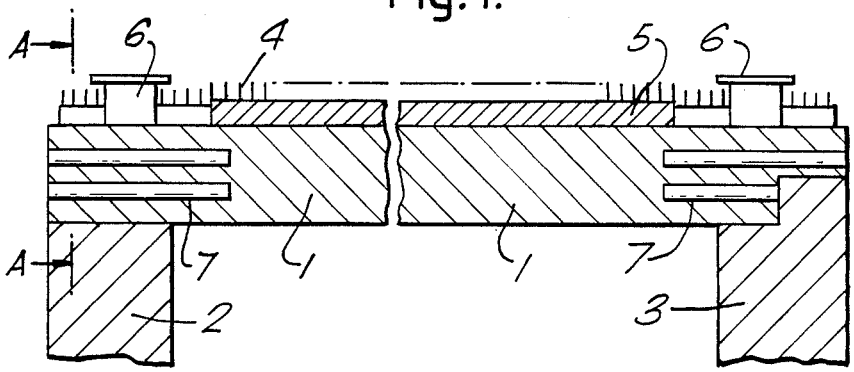
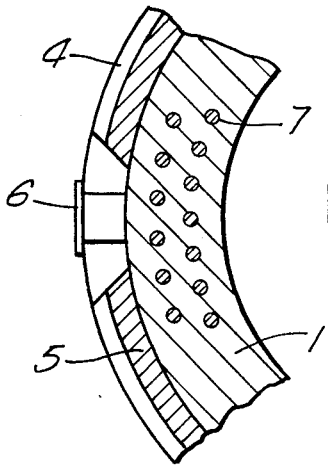
Fig.2.

TRANSPORT AND STORAGE FLASK

The presnt invention concerns a flask for the transport and storage of radioactive material.

BACKGROUND OF THE INVENTION

One form of flask comprises a hollow cylindrical body having lifting trunnions adjacent its ends and provided with a jacket of neutron absorbing material. It is not practicable to apply the neutron absorbing material about the flask body in the region of the lifting trunnions and the aim of the invention is to provide alternative means of neutron shielding in the region of the lifting trunnions.

FEATURES AND ASPECTS OF THE INVENTION

According to the present invention a flask for the transport and storage of radioactive material comprises a hollow body having lifting trunnions on the body and external neutron shielding about the body except in the regions of the trunnions, and in which further neutron shielding is provided in blind bores in the wall of the body at each end of the body, the blind bores extending beneath the trunnions to compensate for lack of external shielding at the trunnions and being of sufficient number and length only to extend beneath and slightly overlap the external shielding adjacent the region of each trunnion.

The bores may be in staggered rows in the wall of the body, and the spacing between adjacent bores may be less than twice the diameter of an individual bore.

DESCRIPTION OF THE DRAWINGS

The invention will be described further, by way of example, with reference to the accompanying diagrammatic drawings; in which FIG. 1 is a sectional view of a portion of a flask, and FIG. 2 is a section, not to scale, on A—A in FIG. 1.

DESCRIPTION OF THE PREFERRED EMBODIMENT

A flask for the transport and storage of radioactive material comprises a cylindrical hollow body having a side wall 1, end wall 2 and a lid 3. The side wall 1 carries cooling fins 4 which form a shell or casing about the wall 1 to enclose a neutron absorbing shielding material 5. Lifting trunnions 6 are provided on the side wall adjacent each end thereof. The neutron shielding material 5 extends about the trunions but in the immediate vicinity of each trunnion the exterior of the side wall is bare to permit use of the trunnions. Consequently no external neutron shielding is provided in the immediate vicinity of each trunnion.

To compensate for this lack of external shielding the side wall 1 is formed with blind bores 7 at each end thereof and which extend beneath the trunnions. The bores 7 contain neutron shielding material and are of sufficient length to extend beneath the external shielding in the region of each trunnion. Conveniently the bores 7 are formed in teo staggered rows as seen in FIG. 2. A convenient neutron shielding material is silicon rubber and a boron containing compound.

A preferred flask is of forged-steel construction having enhanced impact strength compared to flasks formed from cast metal. As a consequence the bores 7 can be close together to thereby provide efficient neutron capture in the wall of the flask in the regions of the trunnions. Preferably the spacing between adjacent bores in the ends of the side wall 1 is less than twice the diameter of an individual bore.

We claim:

1. A flask for the transport and storage of radioactive material comprising a hollow body, lifting trunnions on the body and external neutron shielding about the body except in the regions of the trunnions, and in which further neutron shielding is provided in blind bores in the wall of the body at each end of the body, the blind bores extending beneath the trunnions to compensate for lack of external shielding at the trunnions and being of sufficient number and length only to extend beneath and slightly overlap the external shielding adjacent the region of each trunnion.

2. A flask according to claim 1 in which the bores are in staggered rows in the wall of the body.

3. A flask according to claim 2 in which the spacing between adjacent bores is less than twice the diameter of an individual bore.

4. A flask according to claim 1 in which the body is a forged-steel construction.

* * * * *